US011428511B2

(12) United States Patent
Lumley

(10) Patent No.: US 11,428,511 B2
(45) Date of Patent: Aug. 30, 2022

(54) LINEAR SHAPED CHARGE AND STRUCTURE

(71) Applicant: LINEAR SHAPED LIMITED, Hartlepool (GB)

(72) Inventor: Andrew Lumley, Alston (GB)

(73) Assignee: LINEAR SHAPED LIMITED, Hartlepool (GB)

( * ) Notice: Subject to any disclaimer, the term of this patent is extended or adjusted under 35 U.S.C. 154(b) by 206 days.

(21) Appl. No.: 16/588,444

(22) Filed: Sep. 30, 2019

(65) Prior Publication Data

US 2020/0141705 A1 May 7, 2020

Related U.S. Application Data

(63) Continuation of application No. PCT/GB2018/050854, filed on Mar. 29, 2018.

(30) Foreign Application Priority Data

Mar. 31, 2017 (GB) ..... 1705261

(51) Int. Cl.

| | |
|---|---|
| ***F42B 1/028*** | (2006.01) |
| ***F42B 1/02*** | (2006.01) |
| ***F42B 1/036*** | (2006.01) |
| ***F42B 33/02*** | (2006.01) |
| *F42B 3/08* | (2006.01) |
| *F42B 1/024* | (2006.01) |

(52) U.S. Cl.

CPC ..... *F42B 1/028* (2013.01); *F42B 1/02* (2013.01); *F42B 1/036* (2013.01); *F42B 33/0207* (2013.01); *F42B 1/024* (2013.01); *F42B 3/08* (2013.01)

(58) Field of Classification Search

CPC .... F42B 1/00; F42B 1/02; F42B 1/024; F42B 1/028; F42B 1/032; F42B 1/036; F42B 33/0207; F42B 3/08

USPC ..... 102/305–310

See application file for complete search history.

(56) References Cited

U.S. PATENT DOCUMENTS 5,524,546 A * 6/1996 Rozner ..... F42B 3/08 102/202.7
H2039 H * 8/2002 Holt ..... 102/307
(Continued)

FOREIGN PATENT DOCUMENTS

DE 3739683 A1 6/1989
DE 19919041 A1 11/2000
(Continued)

OTHER PUBLICATIONS

International Search Report and Written Opinion dated Jun. 25, 2018 for PCT Application No. PCT/GB2018/050854.
(Continued)

*Primary Examiner* — James S Bergin
(74) *Attorney, Agent, or Firm* — EIP US LLP

(57) ABSTRACT

A linear shaped charge comprising a body comprising a foam material, a first explosive element, a second explosive element, a liner and a channel at least partly between the first explosive element and the second explosive element. A related structure is also described, with a first cavity configured to receive a first explosive element and a second cavity configured to receive a second explosive element.

13 Claims, 7 Drawing Sheets

(56) References Cited

U.S. PATENT DOCUMENTS

| | | | | |
|---|---|---|---|---|
| 8,978,558 | B2 * | 3/2015 | Lumley | F42B 1/036 102/307 |
| 9,175,936 | B1 | 11/2015 | Collier | |
| 9,746,292 | B2 * | 8/2017 | Alford | F42B 12/367 |
| 10,982,936 | B2 * | 4/2021 | Lumley | F42B 3/087 |
| 2015/0219427 | A1 | 8/2015 | Alford et al. | |

FOREIGN PATENT DOCUMENTS

| | | | | | |
|---|---|---|---|---|---|
| GB | 2553483 | A | * | 3/2018 | F42B 3/087 |
| WO | 2017141050 | A1 | | 8/2017 | |
| WO | WO-2018178699 | A1 | * | 10/2018 | F42B 33/0207 |

OTHER PUBLICATIONS

United Kingdom Search Report dated Nov. 10, 2017 for GB Application No. 1705261.4.

* cited by examiner

LINEAR SHAPED CHARGE AND STRUCTURE

CROSS-REFERENCE TO RELATED APPLICATIONS

This application is a continuation of International Application No. PCT/GB2018/050854, filed Mar. 29, 2018 which claims priority to UK Application No. GB 1705261.4, filed Mar. 31, 2017, under 35 U.S.C. § 119(a). Each of the above-referenced patent applications is incorporated by reference in its entirety.

BACKGROUND OF THE INVENTION

Field of the Invention

Linear shaped charges may be used for civil and military engineering applications, for example cutting non-metal structures such as masonry, or metal structures such as a hull of a ship, a fuselage of an aircraft, a structural support or munition casing.

Manufacture of a linear shaped charge can require specialist machinery and hence can be expensive and feasible only at certain factories.

It is desirable to address this problem.

DETAILED DESCRIPTION OF CERTAIN INVENTIVE EMBODIMENTS

Figure 1:
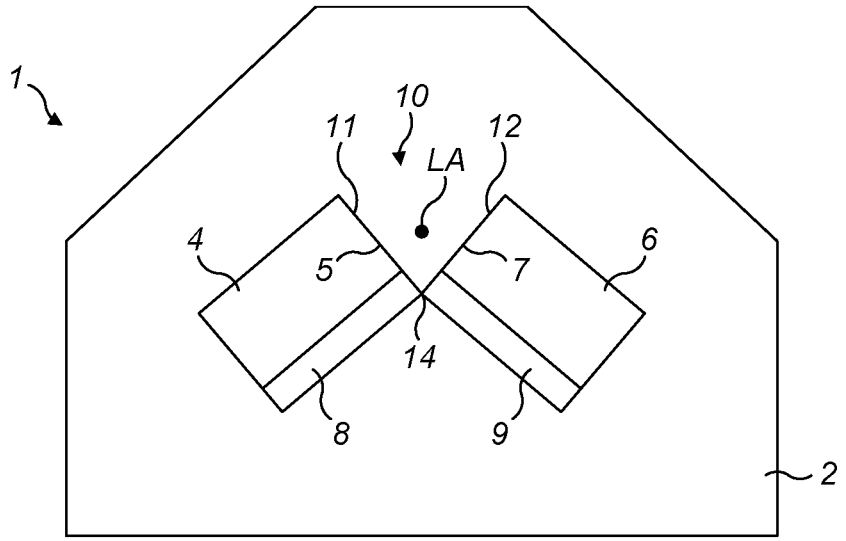
FIGS. 1 to 8 show schematically cross-sectional views of a linear shaped charge according to examples.

Explosive charges may be used for various engineering tasks, for example in cutting materials such as metals and non-metals. Explosive charges may therefore be useful for breaching structures, such as a wall, for people to pass through. Linear cutting charges, or linear shaped charges, in particular are often used to cut through structures. In general, a linear shaped charge may comprise an explosive element, a liner, and in some examples a face for application to a target object, with the liner arranged for projection towards the face when the explosive element is detonated.

For example, a liner for a linear shaped charge may be, before detonation, a longitudinal element having a V-shaped cross section and formed, for example, of copper or a material comprising copper or another suitable metal. The apex of the V-shape is located further from the target object than the two sides or limbs of the V-shape—the shape may be considered an inverted 'V' or chevron. In some examples, the V-shaped liner may be a metallic layer which extends around a side of the charge to be applied to a target object, to surround, when viewed in cross-section, the explosive material of the linear shaped charge.

Linear shaped charges may comprise a space between the liner and the face, the liner being arranged for projection through the space after the explosive element (located on a side of the liner furthest from the target object) is detonated. At least part of the space may be filled with a filling material. Linear shaped charges may also comprise a casing surrounding at least part of the explosive element. The casing and/or filling material may comprise foam, for example be completely formed of foam, partly formed of foam, or mostly formed of foam (at least 95% foam). The foam may be low density polyethylene (LDPE) foam. The casing and the filling material may be integrally formed.

A linear shaped charge may be flexible along a longitudinal axis. This allows the target object to be cut with a curved shape when the linear shaped charge is detonated. In examples, flexible typically means that the linear shaped charge may be bent, twisted, or otherwise deformed, for example along or relative to a longitudinal axis of the linear shaped charge, for example by a human with their hands without any tools. A linear shaped charge may have elastic properties, so that the linear shaped charge at least partly returns to a pre-deformed configuration. Alternatively, the linear shaped charge may have plastic properties, so that for example the linear shaped charge at least partly retains a deformed configuration after being deformed. In some examples, a linear shaped charge may be similar to a linear shaped charge described above, but which is substantially rigid or non-flexible, and therefore not deformable by a human with their hands without any tools, for example. Such non-flexible examples may include a linear shaped charge with a rigid copper or other metal liner.

In use, a linear shaped charge is applied to a target object for cutting. Following detonation of the explosive element in the charge, the (metal) liner about either side of the apex is projected onto the axis of symmetry and the resultant elastic collision forces a cutting jet towards the target object. The cutting jet is linear, along a longitudinal axis of the charge, and therefore cuts the target object along a line defined by a configuration of the charge when applied to the target object. This may be a curved linear configuration. The shape and depth of the cut may be finely controlled, by selecting appropriate dimensions and explosive loadings in the charge. Accordingly, linear shaped charges have many and varied applications, both civil and military, where a clean and controlled cut is required. Given the high cutting power, linear shaped charges may be used to cut concrete or metallic structures, for example when breaching walls or demolishing building structures. The precision of the line and depth of the cut allows for delicate cutting operations, for example cutting of a munition casing.

Examples of a linear shaped charge will now be described, in which the linear shaped charge comprises a body comprising a foam material; a first explosive element; a second explosive element; a liner; and a channel at least partly between the first explosive element and the second explosive element. The presence of two or more (separate) explosive elements, which may be separately detonatable, allows for a simpler linear shaped charge construction. For example, the first and second explosive elements may be elongate blocks of explosive material, such as cuboid-shaped blocks, which are easier and less expensive to manufacture than a singular elongate explosive element having a chevron-shaped or V-shaped cross section. Having first and second explosive elements angled towards each other with a channel at least partly between them—for example without an apex section as compared to a singular elongate explosive element having a chevron-shaped or V-shaped cross section—provides a more cost-effective linear shaped charge construction, with a relatively small decrease in jet performance. Accordingly, a new linear shaped charge design has been devised which can be more simply and cost effectively made than known linear shaped charges.

Certain features described herein may be referenced in numerical nomenclature, for example "the second surface of the second explosive element". This labelling nomenclature does not necessarily mean, however, that the second explosive element referred to here also has a first surface. Rather, the numerical labelling is used to make referencing clearer for the reader by avoiding references to numerous "first surfaces", for example.

FIGS. 1 to 8 show examples of a linear shaped charge 1 comprising a body 2 comprising a foam material. The body 2 may be completely formed of, partly formed of, or mostly (at least 95%) formed of foam material. The foam material may be polyethylene foam. The linear shaped charge 1 also comprises a first explosive element 4 and a second explosive element 6, as well as a liner 8. The linear shaped charge further comprises a channel 10 at least partly between the first explosive element 4 and the second explosive element 6.

In some examples, as shown in FIG. 1, a first side 11 of the channel 10 may correspond with a first surface 5 of the first explosive element 4. Similarly, a second side 12 of the channel 10 may correspond with a second surface 7 of the second explosive element 6. The channel 10 may extend along a longitudinal axis LA of the linear shaped charge 1. For example, the channel 10 may extend along at least part of an entire length of the linear shaped charge 1. Similarly, the first explosive element 4 and/or the second explosive element 6 may extend along at least part of the entire length of the linear shaped charge 1.

In some cases, the channel 10 may comprise a space, between the first surface 5 of the first explosive element 4 and the second surface 7 of the second explosive element 6, filled with non-explosive material. In other examples, the channel 10 may be considered a recess or groove. In certain cases, the channel 10 may be at least partly filled by the foam material of the body 2, as shown in FIGS. 1 to 4. In other cases, the channel 10 may comprise empty space, as shown in FIGS. 5 to 8.

Figure 2:
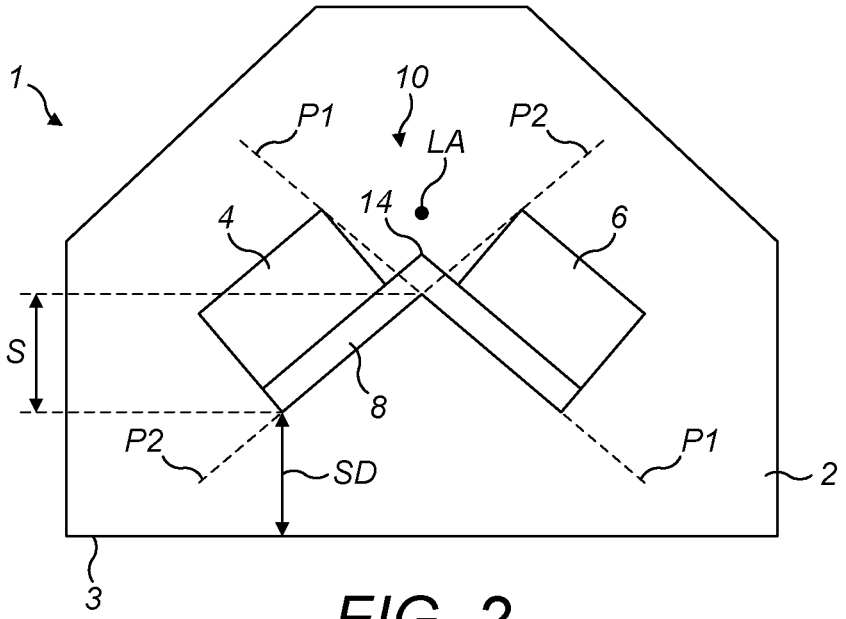
Figure 3:
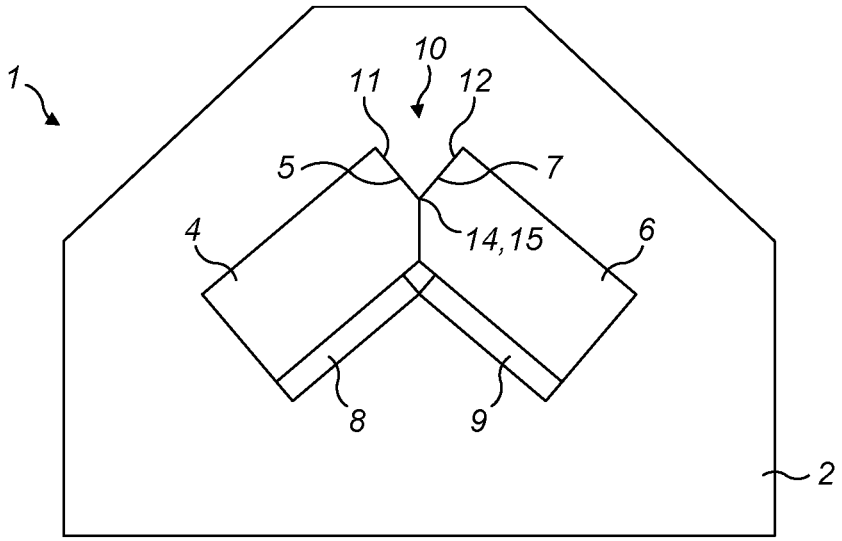

In some examples, as shown in FIG. 2, the liner 8 may have a V-shaped cross section. The term V-shaped includes forms where the two sides of the V, either side of the apex, are equal or unequal in length; preferably the sides are equal in length. The liner 8 may also be in contact with the first explosive element 4 and the second explosive element 6. For example, the liner 8 may be considered to resemble a chevron in cross section, with an apex and two limbs downwardly and divergently extending from the apex. Therefore, in some examples, the first explosive element 4 may be in contact with one of the two limbs, and the second explosive element 6 may be in contact with the other of the two limbs. In certain cases, a base 14 of the channel 10 comprises an edge of an apex of the liner 8. The liner 8, having a V-shaped cross section, may be considered to have an inner apex where interior surfaces of the liner 8 converge, and an outer apex where exterior surfaces of the liner 8 converge. Thus, in certain cases, the base 14 of the channel 10 may comprise an edge of the outer apex of the liner 8.

A side of the first explosive element 4 may be adjacent to or in contact with a first portion of the liner 8. In examples, the side of the first explosive element 4 extends no further than a plane P1 of a side of a second portion of the liner 8 nearest a face 3 of the linear shaped charge 1, which side of the second portion is not in contact with the second explosive element 6, as shown in FIG. 2. This may allow the detonation wavefront upon detonation of the first explosive element 4 to minimally interfere with the detonation wavefront of the second explosive element 6 before the cutting jet is formed. In examples where the liner 8 has a V-shaped cross section, the first portion of the liner 8 may be one of the two limbs of the V-shape, and the second portion of the liner 8 may be the other of the two limbs. This arrangement may therefore improve jet formation in a linear shaped charge 1 with a liner 8 and first and second explosive elements 4, 6. Similarly, a side of the second explosive element 6 adjacent to or in contact with the second portion of the liner 8 may extend no further than a plane P2 of a side of the first portion of the liner 8 nearest the face 3 of the linear shaped charge, which side of the first portion is not in contact with the first explosive element 4.

A stand-off distance SD may be considered a distance between a point of the liner 8 nearest the face 3 of the linear shaped charge 1 and the plane of the face, as shown in FIG. 2. The stand-off distance SD may be taken perpendicular to the plane of the face 3. In examples, the stand-off distance SD may be greater than or equal to 1.2 S, where S is a distance between the point of the liner nearest the face 3 and the apex of the liner nearest the face 3, as shown in FIG. 2. The distance S is taken parallel to the stand-off distance SD and may be perpendicular to the plane of the face 3. In particular cases, the stand-off distance SD may be between 0.8 S and 2.4 S.

In some examples, as shown in FIG. 1, there may be a first liner 8, and the linear shaped charge 1 may comprise a second liner 9. For example, the first liner 8 may be in contact with the first explosive element 4, and the second liner 9 may be in contact with the second explosive element 6. In certain cases, the first liner 8 may be integrated with, for example adhered to, the first explosive element 4, and the second liner 9 may, additionally or alternatively, be integrated with the second explosive element 6.

Figure 4:
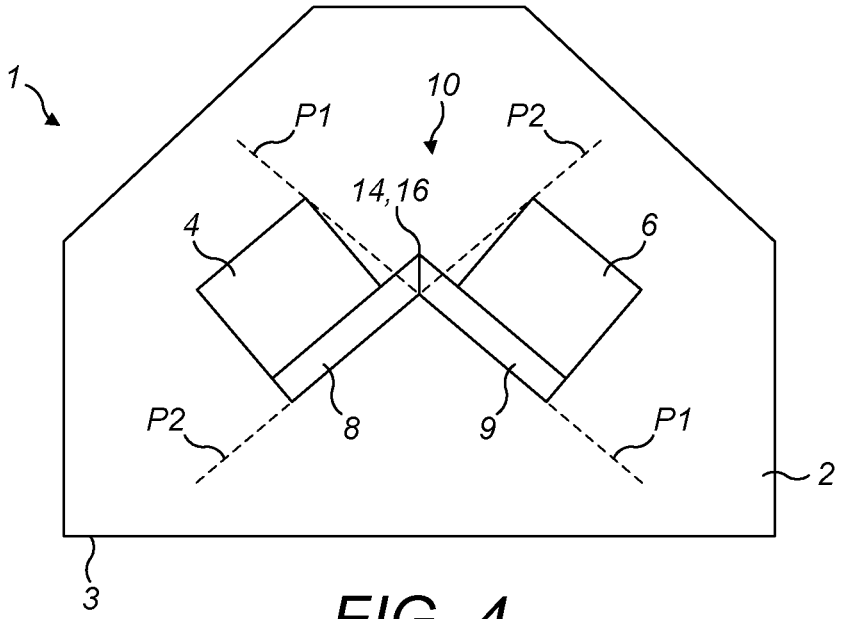

In some examples, a side of the first explosive element 4 in contact with the first liner 8 extends no further than a plane P1 of a side of the second liner 9 nearest the face 3 of the linear shaped charge 1, which side of the second liner is not in contact with the second explosive element 6, as shown in FIG. 4. As described above, this may allow the detonation wavefront upon detonation of the first explosive element 4 to minimally interfere with the detonation wavefront of the second explosive element 6 before the cutting jet is formed. This may therefore improve efficiency of jet formation in the linear shaped charge 1 with first and second explosive elements 4, 6 and first and second liners 8, 9. Similarly, a side of the second explosive element 6 in contact with the second liner 9 may extend no further than a plane P2 of a side of the first liner 8 nearest the face 3 of the linear shaped charge, which side of the first liner is not in contact with the first explosive element 4.

In examples where the linear shaped charge 1 has a first liner 8 and a second liner 9, the stand-off distance SD may be considered as a distance between: a point of the first liner 8 or the second liner 9 nearest the face 3 of the linear shaped charge 1; and a plane of the face 3. In some examples, the stand-off distance SD is at least 1.2 S, S being a distance, parallel to the stand-off distance SD, between the point of the first liner 8 or the second liner 9 nearest the face 3 and the apex of the first liner 8 and the second liner 9 nearest the face 3. The apex of the first liner 8 and the second liner 9 nearest the face 3 may be the interior apex where first liner 8 and the second liner 9 abut in examples where they do abut, as shown in FIG. 4. Alternatively, in examples where the first liner 8 and the second liner 9 do not abut each other, the apex may be the point (in cross section) or edge that first liner 8 and the second liner 9 converge towards. In some examples, such as the example shown in FIG. 3, the first explosive element 4 and the second explosive element 6 abut each other at, or to form, an edge 15, with the base 14 of the channel 10 comprising the edge 15. For example, the abutting explosive elements 4, 6 may be considered to form the edge 15 where they meet or contact one another. The edge 15 may therefore correspond with the base 14 of the channel 10, the channel 10 comprising: a first side 11 corresponding with the first surface 5 of the first explosive element 4; and a second side 12 corresponding with the second surface 7 of the second explosive element 6; as previously described with reference to FIG. 1.

In some examples where the linear shaped charge 1 comprises a first liner 8 and a second liner 9, the first liner 8 and the second liner 9 may abut each other at an edge 16, as shown in FIG. 4. An edge of each of the first liner 8 and the second liner 9 may be mitred, so as to accurately abut each other at the edge 16, as shown in FIG. 4. In these examples, the base 14 of the channel 10 may comprise the edge 16. For example, the abutting liners 8, 9 may be considered to form the edge 16 where they meet or contact one another. The edge 16 may therefore correspond with at least part of the base 14 of the channel 10.

In examples where the first liner 8 and the second liner 9 abut each other, they may together be configured with a V-shaped cross section—in particular examples, the first and second liners 8, 9 may abut each other to form a single edge, for example an inner apex edge as shown in FIG. 1. In other examples, the first and second liners 8, 9 may abut each other to form an inner apex edge and an outer apex edge 16, as shown in the example of FIG. 4.

Figure 5:
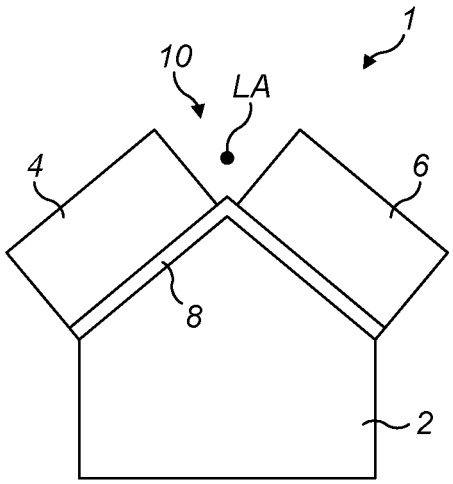

FIG. 5 shows an example of a linear shaped charge 1 where the body 2 supports the liner 8 and the first and second explosive elements 4, 6, with there being a channel 10 at least partly between the first explosive 4 element and the second explosive element 6, as described with reference to the examples shown in FIGS. 1 to 4. The liner 8 may be adhered to the body 2. Additionally or alternatively, the first explosive element 4 and the second explosive element 6 may be adhered to the liner 8. In some examples the linear shaped charge 1 comprises a first liner and a second liner, which may be arranged as described with reference to the examples shown in FIGS. 1 to 4.

The linear shaped charge 1 example shown in FIG. 5 may at least partly be coated, for example by adhesive tape to hold the first and/or second explosive elements, and/or the liner, to the body, or by an inert spray which has dried to form a coating or a film.

In certain cases, a film 13 may be arranged between the liner 8 and the body 2. The film 13 may lie in contact with the liner 8 and the body 2. This may provide excellent energy coupling from the first and second explosive elements 4, 6 when detonated, by way of the cutting jet, through the film 13 and the body 2—particularly when the film 13 lies in contact with both the liner 8 and the body 2—as a space between the liner 8 and the film 13 may otherwise reduce efficiency of the cutting jet.

Moreover, with the film 13 provided between the liner 8 and the body 2, for example in contact with the liner and the body 2, the film 13 may provide stiffness to a perimeter of the body 2 adjacent the liner 8. Therefore, when subjected to increased pressure, for example underwater, a tendency of the body 2 comprising foam material to compress and thus withdraw from contacting the liner 8, may be reduced by the added stiffness given by the film 13. Otherwise, without the film 13 between the liner 8 and the body 2, compression of the body 2 may form a void between the liner 8 and the body 2 which, in an underwater situation, would fill with water, thus introducing water in the space between the liner 8 and the face of the linear shaped charge 1 and interfering with jet production upon detonation; providing a film 13 between the liner 8 and the body 2 overcomes this problem and gives improved underwater operation of the linear shaped charge 1.

In examples, the film 13 may surround at least part of the body 2. For example, the film 13 may cover the longitudinal surfaces of the body 2. Alternatively, the film 13 may cover all surfaces of the body 2. In some examples, the film 13 may cover at least all longitudinal external or exposed surfaces of the linear shaped charge 1, including of the first and second explosive elements 4, 6, any exposed part of the liner 8, and the body 2. Further, the film 13 may cover at least one cross-sectional end of the body and in some examples of the first and second explosive elements and/or the liner(s) too.

The film 13 may comprise a compound comprising bitumen and a surfactant. Such a compound is easy to apply as a paint, for example to the casing and/or filling material. Moreover, this compound when dry advantageously provides structural rigidity in the film 13. This reduces deformation of the linear shaped charge 1 at underwater pressures, especially to the liner 8 and/or body 2, using the film 13. Further, the compound acts as a barrier against water, therefore allowing the film 13 to shield or protect the first and second explosive elements 4, 6 and/or body 2, and/or the liner 8, from water, especially when the charge is submerged underwater. Moreover, the compound may flex without breaking, thus maintaining a continuous film 13, while allowing flexibility of the charge.

Examples of such a film 13 include a compound comprising latex, for example Rockbond RB PL™, which comprises a sub-micrometer particle emulsion in a water base (and is obtainable from Rockbond SCP Ltd, Nayland, Suffolk CO6 4LX, UK), or High Build™, which comprises a complex mixture of bitumens, anionic surfactants, water and a polymer dispersion (and is obtainable from Liquid Rubber Industries, Toronto, Ontario, M5R 1G4, Canada), or an elastomeric membrane, for example EMA urethane polymer, which provides a high-build film and has a longer life than bitumen (and is obtainable from Isothane Limited, Accrington, Lancashire BB5 6NT, UK).

Figure 6:
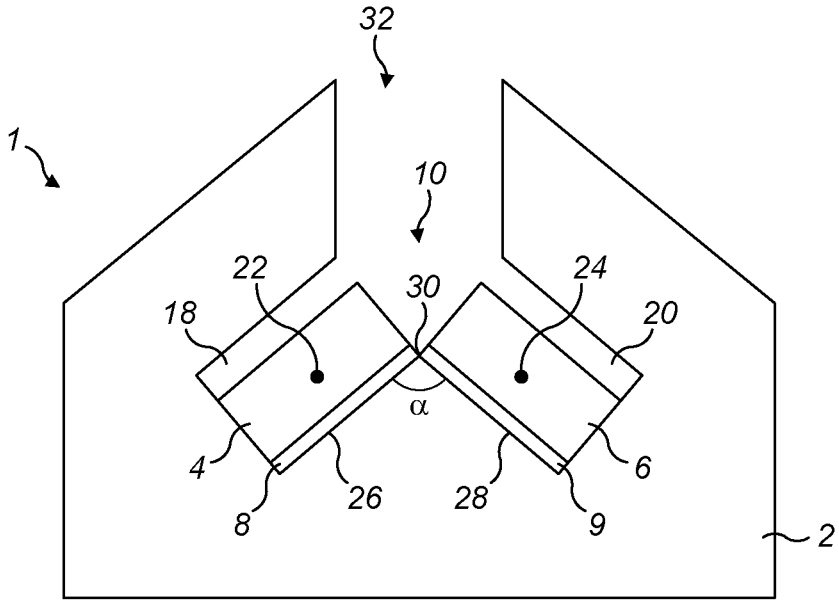

In some examples, as shown in FIG. 6, the body 2 of the linear shaped charge 1 comprises a first cavity 18 and a second cavity 20. The first explosive element 4 may be contained within the first cavity 18, and the second explosive element 6 may be contained within the second cavity 20. For example, the first cavity 18 and the second cavity 20 may be respective spaces in the foam body 2 for receiving an entity or entities, such as a liner and/or explosive material. In certain cases, the first and second cavities 18, 20 may each be a slot or slit extended a long a length of the body 2 for receiving explosive material. The first cavity 18 may extend along a first longitudinal axis 22 of the body 2, and the second cavity 20 may extend along a second longitudinal axis 24 of the body 2. For example, the first and second cavities 18, 20 may extend parallel to each other along a length of the body 2. In some particular examples, the first and second cavities 18, 20 may extend along the entire length of the body 2, such that a cross section of an end of the linear shaped charge 1 would appear as shown in FIG. 6. In other examples, the first and second cavities 18, 20 do not extend along the entire length of the body 2, such that a cross section at a point along the body 2 where the cavities 18, 20 do extend would appear as in FIG. 6, but a cross section at an end of the body 2 would appear as the outline shape of the body 2 filled completely by the foam material of the body 2.

In examples, the first cavity 18 comprises a first flat surface 26 and the second cavity 20 comprises a second flat surface 28. A flat surface may be considered to be a substantially level or even surface, for example which does not have any protrusions, indentations, or other surface irregularities, within acceptable manufacturing tolerances. Such a substantially level or even surface may still comprise indentations, for example partial foam cells. The first flat surface 26 and the second flat surface 28 may converge towards an apex 30, as shown in FIG. 6. In certain cases, the apex 30 has an interior apex angle $\alpha$ of 80 to 120 degrees. In other cases, the interior apex angle of apex 30 may be 101.5 to 106.5 degrees, 102 to 106 degrees, 102.5 to 105.5 degrees or 103 to 105 degrees.

In these examples, the first flat surface 26 of the first cavity 18 and the second flat surface 28 of the second cavity 20 may each be in contact with the liner 8 of the linear shaped charge 1. For example, the first flat surface 26 and the second flat surface 28 may correspond with the liner 8 such that the liner 8 rests on the first flat surface 26 and the second flat surface 28. In examples where the liner 8 has a V-shaped cross section, this cross section may correspond with the first flat surface 26 and the second flat surface 28 in convergence towards an apex 30. In examples where the linear shaped charge 1 comprises a first liner 8 and a second liner 9, the first flat surface 26 may correspond with the first liner 8, and the second flat surface 28 may correspond with the second liner 9. For example the first liner 8 may be parallel, and/or in contact, with the first flat surface 26, and the second liner 9 may be parallel, and/or in contact, with the second flat surface 28.

In certain cases, at least one of the first explosive element 4 and the second explosive element 6 may comprise detonation cord. Detonation cord may also be referred to as detonating cord, and generally comprises a flexible plastic tube filled with explosive material. In examples, the detonation cord may have an explosive mass per unit length of 10 g/m (grams per metre) and a diameter between 4.7 and 5.4 mm (millimetres), for example 5 mm. In other examples, the detonation cord may have an explosive mass per unit length of 5.3 g/m and a diameter of 4.0 mm, or an explosive mass per unit length of 20 g/m and a diameter of 6.4 mm, or an explosive mass per unit length of 40 g/m and a diameter of 7.9 mm or 8.5 mm.

Figure 7:
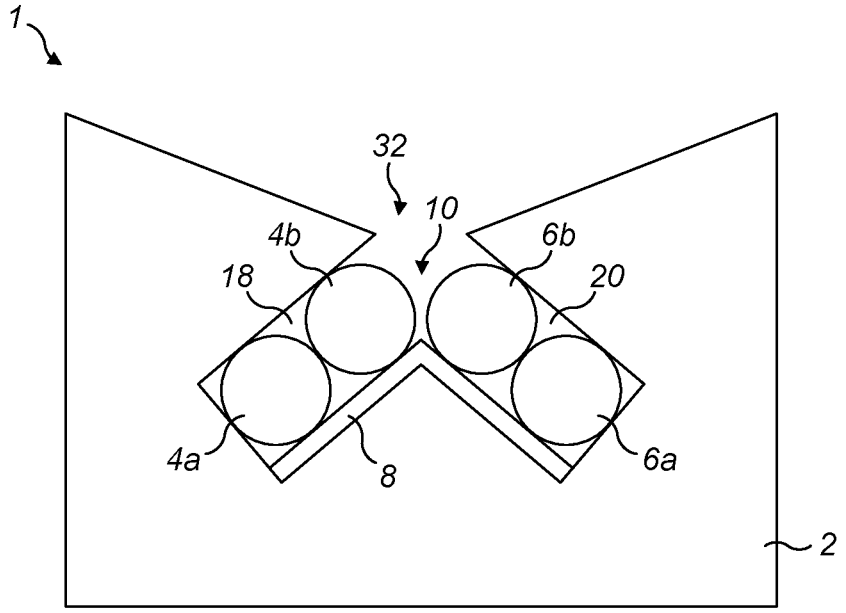

In the example of FIG. 7, the first explosive element comprises a plurality of detonation cord 4*a*, 4*b* and the second explosive element comprises a plurality of detonation cord 6*a*, 6*b*. In other examples, there may be more strands of detonation cord comprised as the first explosive element 4 and/or the second explosive element 6.

In some examples, the body 2 comprises an opening 32 connected to the first cavity 18 and the second cavity 20, as shown in FIGS. 6 and 7. The opening 32 may, for example, allow a user to place the first explosive element 4 and the second explosive element 6 in their respective cavity 18, 20. In some examples, the opening 32 may allow the liner 8, or first liner 8 and second liner 9, to be positioned in the body 2 by the user. In other examples, the liner 8, or first liner 8 and second liner 9, may be manufactured integrally with the body 2, such that the user positions the first explosive element 4 and the second explosive element 6 in the first cavity 18 and the second cavity 20, respectively, to form the linear shaped charge 1.

As previously described, the first cavity 18 and second cavity 20 may each be a slit in the body 2 for receiving and retaining the first explosive element 4 and the second explosive element 6, respectively. The relative size of the slit compared to the respective explosive element may allow for contact between inside surfaces of the cavity 18, 20 and the respective explosive element 4, 6. For example, where the first cavity 18 is narrower than the width of the first explosive element 4, the presence of the first explosive element 4 inside the first cavity 18 may deform the foam body 2 at surfaces of the first cavity 18, to give resistance and friction to movement of the first explosive element 4. This effect may help securely retain the first explosive element 4 inside the first cavity 18. For example, where the first explosive element 4 comprises detonation cord 4*a*, 4*b*, the user may form the linear shaped charge 1 by forcing or squeezing the detonation cord 4*a*, 4*b* into the first cavity 18, which is narrower than the diameter of the detonation cord 4*a*, 4*b* in this example. The first cavity 18 may then act as a pocket for the detonation cord 4*a*, 4*b*; securely retaining the detonation cord 4*a*, 4. In examples where the linear shape charge 1 is flexible, the first cavity may allow for the detonation cord 4*a*, 4*b* to be retained securely during flexing of the linear shaped charge 1. These features may be equally applied to the second cavity 20 and the second explosive element 6, which may comprise detonation cord 6*a*, 6*b*.

In certain cases, the first cavity 18, and additionally or alternatively the second cavity 20, may have a respective inlet portion and a respective retainer portion. The inlet portion may be narrower than the retainer portion. For example, the respective inlet portion of the first cavity 18 may be narrow relative to the first explosive element 6 such that the first explosive element 6 requires forcing through the narrow inlet portion of the first cavity 18 until the first explosive element 6 reaches the wider retaining portion, where it is retained securely, with exit via the narrower inlet portion possible only by force. This equally applies to the second cavity 20 and the second explosive element 6. Therefore, in some examples, the first explosive element 4 may be contained within the retainer portion of the first cavity 18, and the second explosive element 6 may be contained within the retainer portion of the second cavity 20.

Figure 8:
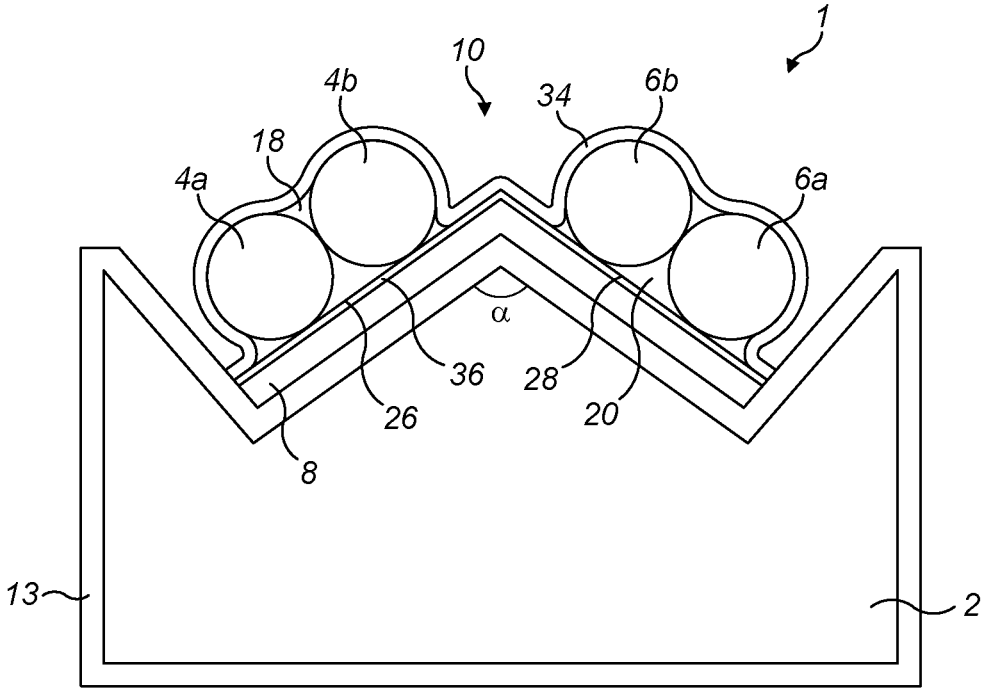

In the example shown in FIG. 8, the body 2 is surrounded by a film 13 arranged between the body 2 and the liner 8. The first explosive element comprises a plurality of detonation cord 4*a*, 4*b* and the second explosive element comprises a plurality of detonation cord 6*a*, 6*b*, as in the example of FIG. 7. The first cavity 18 and the second cavity 20 are each formed between an elastic layer 34 and an intermediate layer 36. The first flat surface 26 of the first cavity 18, and the second flat surface 28 of the second cavity 20 may each coincide with a surface of the intermediate layer 36, as shown in FIG. 8. The intermediate layer is for example between the first and second cavities and the liner.

The elastic layer 34 may be formed from an elastic material, for example a material containing elastomeric filaments or elastic yarn, which may comprise polyester or polyamide. The intermediate layer 36 may be formed of a polymer, which is coated in certain cases. For example, the intermediate layer 36 might comprise polyester coated with a vinyl polymer. A coated polymer intermediate layer 36 may provide flexibility, durability, and climatic resilience. The intermediate layer 36 may be bonded or adhered to the liner 8, for example by a glue or other adhesive.

The elastic layer 34 may be attached to parts of the intermediate layer 36 at particular locations, for example by stitching. In the example of FIG. 8, the elastic layer 34 is attached to the intermediate layer 36 at each lateral edge of the liner 8, shown in cross-section, and at a region at or around the apex of the liner 8. The first and second cavities 18, 20 may be formed in respective regions where the elastic layer 34 is not attached to the intermediate layer 36. For example, the elastic layer 34 may be deformed, for example stretched, in order for the first and second explosive elements 4*a*, 4*b*, 6*a*, 6*b* to be received by the first and second cavities 18, 20, respectively.

To construct the example linear shaped charge 1 shown in FIG. 8, detonation cord 4*a*, 4*b*, 6*a*, 6*b* may be fed into the first and second cavities 18, 20 and drawn through the respective cavity along a length of the linear shaped charge 1. For example, the first cavity 18 may contain a single piece of detonation cord 4*a*, 4*b* that extends along the length of the linear shaped charge 1 and is looped at one end such that the piece of detonation cord returns back on itself along the length of the linear shaped charge 1 to give a first detonation cord strand 4*a* and a second detonation cord strand 4*b* in cross section. The same may respectively apply to the second cavity 20 and corresponding detonation cord 6*a*, 6*b*. The detonation cord strands 4*a*, 4*b*, 6*a*, 6*b* may be gathered at an end of the linear shaped charge 1, and bundled for initiation.

Tension in the deformed or stretched elastic layer 34 may hold the detonation cord 4*a*, 4*b*, 6*a*, 6*b* in place and may also improve energy coupling between the detonation cord 4*a*, 4*b*, 6*a*, 6*b* and the liner 8 by biasing or holding the detonation cord towards the liner. In certain examples, the elastic layer 34 may not extend continuously along the length of the linear shaped charge 1. For example, the elastic layer 34 may instead be arranged in discontinuous portions along the length of the linear shaped charge 1, with gaps between the portions.

In certain examples, there may be a plurality of elastic layers forming a plurality of cavities, with a respective cavity between two of the elastic layers. Each of the plurality of cavities may comprise or be filled with detonation cord, such that the detonation cords in one cavity tessellate with detonation cords in an underlying cavity. This can give a greater explosive loading to a linear shaped charge, with denser packing of the detonation cords than if they did not tessellate.

In any of the examples described, the first explosive element 4 may be connected to a first detonation system and the second explosive element 6 may be connected to a second detonation system. A detonation system may comprise one, or a respective, detonator in contact with, or inserted into, the first explosive element 4 or the second explosive element 6, for example. An alternative detonation system may be a detonator or initiator connected to detonation cord with is in contact with, or inserted into, the first explosive element 4 or the second explosive element 6. In certain cases, the first detonation system and the second detonation system are coupled to each other. For example, if the first and second detonation systems are detonators inserted into the respective explosive element 4, 6, the detonators may be coupled to each other by detonation cord connected respectively to each of the detonators—the detonation cord may be connected to the same initiation source, for example, or entwined or otherwise coupled. The coupled first and second detonation systems may be configured to simultaneously detonate the first explosive element 4 and the second explosive element 6, for example by configuring the respective lengths of the detonation cord between an initiation point of the detonation cord and the respective explosive element 4, 6 to be equal. Where a detonator is inserted into the first explosive element 4 or the second explosive element 6, the detonator may be inserted into or at an end of the respective explosive element 4, 6.

The first explosive element 4 and the second explosive element 6 may comprise respective materials with different detonation propagation speeds in any of the examples described. For example the first explosive element 4 may have a higher detonation propagation speed than the second explosive element 6 such that, upon detonation of the first explosive element 4 and the second explosive element 6, the detonation wave front in the first explosive element 4 propagates along a length of the first explosive element 4 at a higher speed than the detonation wave front in the second explosive element 6 propagates along a length of the first explosive element 6. The relative detonation propagation speeds of the first explosive element 4 and the second explosive element 6 may therefore be configured such that, where the linear shaped charge 1 is flexible and in a bent or curved configuration when detonated, the detonation wave fronts in the first and second explosive elements 4, 6 propagate synchronously. This may be done, for example, by compensating for a longer path length of the first explosive element 4 with a higher detonation propagation speed. Thus, if the linear shaped charge is in a curved configuration with the first explosive element 4 having a larger radius of curvature than the second explosive element 6, and the first and second explosive elements 4, 6 are detonated at the same time, the ratio of the detonation propagation speeds can be chosen such that the detonation wave fronts of the first and second explosive elements 4, 6 arrive at the end of the respective explosive element 4, 6 at the same time.

The foam material of the body 2 in any of the described examples may be formed of low density polyethylene (LDPE) foam. The foam material may have a density of 15 to 60 kg $m^{-3}$ (kilograms per cubic metre), 25 to 60 kg $m^{-3}$, 35 to 60 kg $m^{-3}$, and more preferably 45 to 60 kg $m^{-3}$, 50 to 60 kg $m^{-3}$, or 55 to 60 kg $m^{-3}$ to give structural support to the linear shaped charge 1.

The first cavity 18 and the second cavity 20 may each be cut out or excavated from a block or cuboid of foam material. The dimensions of the first and second cavities 18, 20 may be configured or adapted to correspond with the shape and size of the first explosive element 4 and the second explosive element 6, respectively. In any of the examples described herein, the first cavity 18 and the second cavity 20 may each have a rounded interior surface, for example a rounded surface at the end of the cavity 18, 20.

The liner 8, or the first liner 8 and the second liner 9, may be rigid or flexible. For example, the liner(s) 8, 9 may be formed from a rigid metal, such as copper, or a mixture of metals. Alternatively, the liner(s) 8, 9 may comprise a material of particles comprising metal dispersed in a polymer matrix. For example, the particles may comprise at least one metal selected from the group consisting of: copper (Cu), tungsten (W), molybdenum (Mo), aluminium (Al), uranium (U), tantalum (Ta), lead (Pb), tin (Sn), cadmium (Cd), cobalt (Co), magnesium (Mg), titanium (Ti), zinc (Zn), zirconium (Zr), beryllium (Be), nickel (Ni), silver (Ag), gold (Au), platinum (Pt), and/or an alloy thereof. The polymer matrix may comprise polyisobutylene, di(2-ethylhexyl) sebacate (DEHS) and polytetrafluoroethylene (PTFE), for example.

The first explosive element 4 and the second explosive element 6 may comprise, for example, a mixture of 88 wt % (percentage by weight) RDX (cyclotrimethylenetrinitramine), 8.4 wt % PIB (polyisobutylene), 2.4 wt % DEHS (di(2-ethylhexyl) sebacate), and 1.2 wt % PTFE (polytetrafluoroethylene), the percentage by weight (wt %) being a percentage of the weight of the respective explosive element. Alternatively, the first explosive element 4 and the second explosive element 6 may comprise SX2/Demex Plastic Explosive from BAE Systems, Glascoed, USK, Monmouthshire NP15 IXL UK, or Primasheet 2000 Plastic Explosive from Ensign-Bickford Aerospace & Defense Company, Simsbury, Conn. 06070 USA.

The foam material of the body 2 may be manufactured by a suitable cutting or grinding process. The components may then be assembled to form the charge 1, including any adhering of the components to one another.

In use, the linear shaped charge 1 is applied to a target object, for example the charge 1 may be adhered to, or otherwise held in position on, the target object. The charge 1 may be flexible along a longitudinal axis, by choosing appropriate materials of the component parts of the charge. Such flexibility means the charge may be applied in a curved configuration on the target object, for example with a face of the charge on a planar surface of the target object, or with the face following contours of a non-planar surface of the target object.

Once the charge 1 is applied to the target object, the first and second explosive elements 4, 6 may be detonated, for example simultaneously. One or more electrical detonators may be used as detonation means, possibly connected to each other or the explosive elements 4, 6 by detonating cord. Upon detonation, the liner 8 (or each liner 8, 9) is projected towards the target object as a jet. In examples where the linear shaped charge comprises a V-shaped liner 8 with an apex, or a first liner 8 and a second liner 9 that meet at an apex to form a V-shaped cross section, the jet originates from the apex of the liner(s). In examples where the linear shaped charge 1 comprises a first liner 8 and a second liner 9, that do not meet or abut each other, the respective wave-fronts following detonation travel towards a face of the linear shaped charge 1 in a direction perpendicular to the respective first liner 8 and second liner 9, and meet at an apex in the space between the liners and the face of the charge 1 to form a jet that penetrates the target object perpendicular to the surface of the target object. Such a first liner 8 and a second liner 9 work together, even if spatially separated such that they abut only at an edge or not at all, as a single liner would in a linear shaped charge 1, despite the presence of the channel.

The respective detonation wave-fronts of the first explosive element 4 and the second explosive element 6 meet at an axis or plane of symmetry between the explosive elements 4, 6. The cross-sectional shape of each of the first explosive element 4 and the second explosive element 6 may be tapered to widen the respective explosive element at an end furthest from the face or target object. This may allow for the shape and/or direction of the respective detonation wave-front to be adjusted or tuned.

The jet penetrates the target object along the length of the charge, thus cutting the target object. A linear shaped charge according to the described examples may be used to cut many different target objects, of various shapes with varying complexity, and formed of numerous different materials, organic and inorganic, for example metal, concrete, mineral, or plastic.

Examples of a structure for forming a linear shaped charge will now be described, with reference to FIGS. 9 to 14. The structure may be an implementation of the linear shaped charge 1 according to an example described herein, but with an absence of explosive material. For example, the structure may be considered a user-fillable linear shaped charge, in other words a structure that may become a linear shaped charge upon filling at least partly with explosive material.

FIGS. 9 to 14 show a structure 100 for forming a linear shaped charge. Features described below which are similar to or the same as those features described in context of the linear shaped charge 1, with reference to FIGS. 1 to 8, will be given the same reference numeral but incremented by 100. Corresponding descriptions apply here also, with some differences, or specificities of those features, in the context of a structure 100 for forming a linear shaped charge, now elaborated on.

The structure 100 for forming a linear shaped charge has a body 102 comprising a foam material. The body 102 may, for example, be formed from a foam material such as polyethylene foam. The body 102 comprises a first cavity 118 and a second cavity 120.

Figure 9:
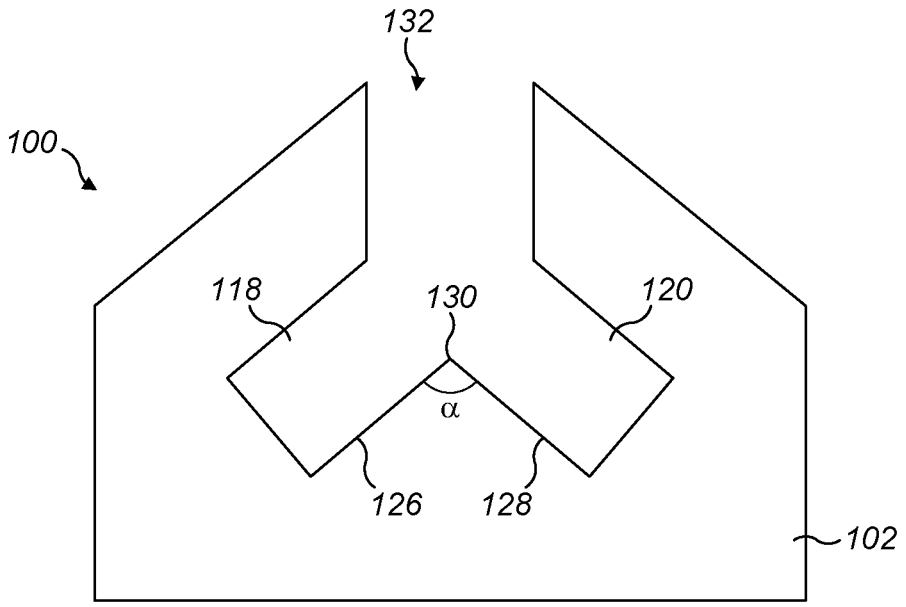
FIGS. 9 to 14 show schematically cross-sectional views of a structure, for forming a linear shaped charge, according to examples.
Figure 10:
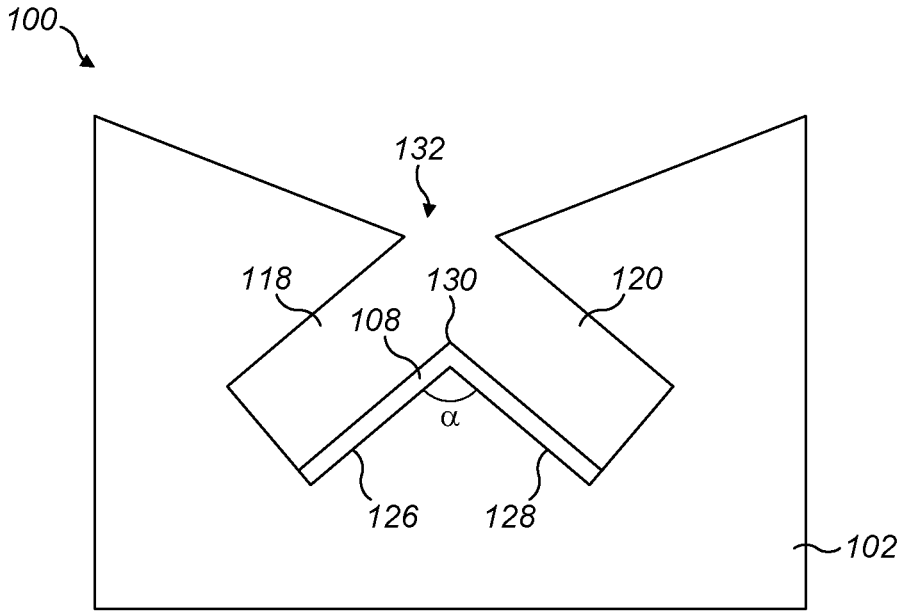

The first cavity 118 has a first flat surface 126 and the second cavity 120 has a second flat surface 128. The first flat surface 126 and the second flat surface 128 converge towards an apex 130. In some examples, the first flat surface 126 and the second flat surface 128 may meet at the apex 130, as shown in FIGS. 9 and 10, whereas in other examples, the two flat surfaces 126, 128 may not meet but their respective extrapolated planes intersect at the apex 130.

Figure 12:
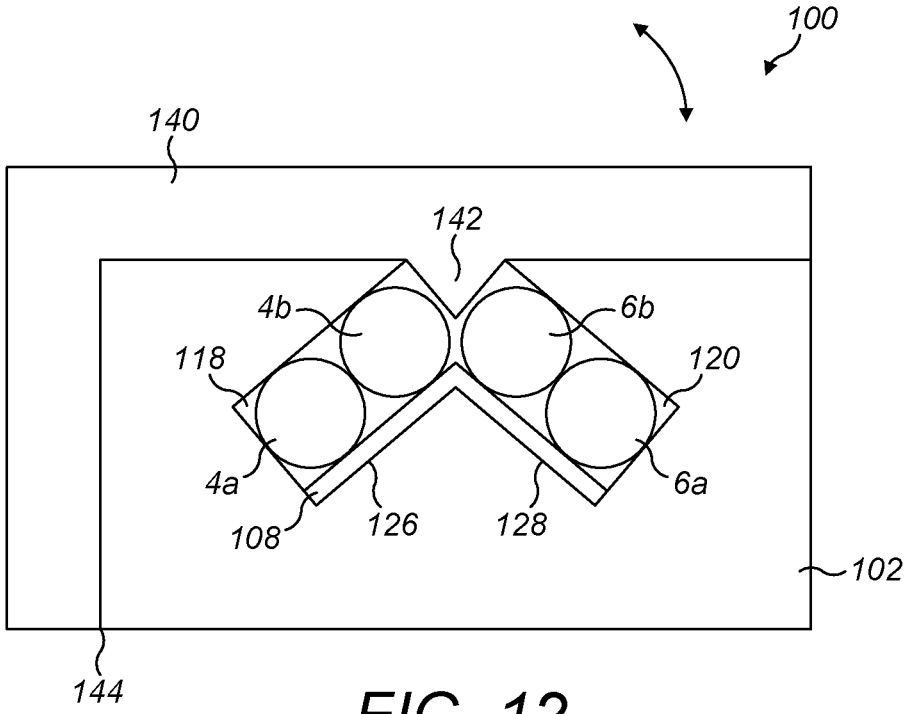

The first cavity 118 is configured to receive a first explosive element, and the second cavity 120 is configured to receive a second explosive element, such that a channel, at least partly between the first explosive element and the second explosive element, comprises: a first side corresponding with a first surface of the first explosive element; and a second side corresponding with a second surface of the second explosive element. For example, the structure 100 may receive first and second explosive elements to form a linear shaped charge 1 as described with reference to that aspect, and FIGS. 1 to 8. FIG. 12 shows such an example with the structure 100 forming a linear shaped charge by the presence of explosive elements 4*a*, 4*b*, 6*a*, 6*b* in contact with the liner 108. The first and second explosive elements may comprise plastic explosives, for example, and/or detonating cord. In examples, the first and second explosive elements are pre-cut blocks of explosive material that may be positioned in the first cavity 118 and the second cavity 120 such that the channel, at least partly between the first explosive element and the second explosive element, is formed. In certain cases, the first and second explosive elements comprise detonating cord, and the first surface of the first explosive element may be a curved surface of the detonating cord—similarly for the second surface of the second explosive element—with the channel at least partly between the first explosive element and the second explosive element. This is shown in the example of FIG. 12 and in the linear shaped charge example, comprising detonating cord, in FIG. 7.

An apex angle $\alpha$ between the first flat surface 126 and the second flat surface 128 may be considered to be the interior angle of the apex 130 that the first and second flat surfaces 126, 128 converge towards. In examples, the apex angle is 101.5 to 106.5 degrees. In other examples, the apex angle may be 102 to 106 degrees, 102.5 to 105.5 degrees or 103 to 105 degrees.

In some examples, the first cavity 118 and the second cavity 120 comprise a liner 108 in contact with the first flat surface 126 and the second flat surface 128. This is shown in the example of FIG. 10. The first flat surface 126 and the second flat surface 128 may correspond with the liner 108 such that the liner 108 rests on the first flat surface 126 and the second flat surface 128. For example, in cases where the liner 108 has a V-shaped cross section, this cross section may correspond with the first flat surface 126 and the second flat surface 128 in convergence towards the apex 130, as shown in FIG. 10.

In examples, the first cavity 118 may comprise a first liner in contact with the first flat surface 126, and the second cavity 120 may comprise a second liner in contact with the second flat surface 120. The first and second liners may abut each other at an edge, for example, with the edge corresponding with the apex 130. In certain cases, the first and second liners may not contact one another, but may still be angled towards each other, for example due to resting on the converging first and second flat surfaces 126, 128.

In cases where at least one of the first explosive element 4 and the second explosive element 6 comprises detonation cord, the liner 108 or liners may be flexible or mouldable such that the detonation cord 4*a*, 4*b*, 6*a*, 6*b* may be pressed into the liner 108 or liners when assembling the linear shaped charge from the structure 100. This may allow the detonation cord 4*a*, 4*b*, 6*a*, 6*b* to be securely held in the respective cavity 118, 120 of the structure 100. Such a flexible liner may comprise metal particles dispersed in a polymer matrix, for example.

In some examples, the first cavity 118 may comprise a first inlet portion and a first retainer portion, with the first inlet portion narrower than the first retainer portion. Similarly, the second cavity 120 may comprise a second inlet portion and a second retainer portion, with the second inlet portion narrower than the second retainer portion.

In examples, the first inlet portion is configured to receive the first explosive element, and the first retainer portion may be configured to retain the first explosive element. Similarly, the second inlet portion may be configured to receive the second explosive element, and the second retainer portion may be configured to retain the second explosive element.

The relative narrowness of the first and second inlet portions in relation to their respective retainer portion may allow explosive material to be inserted into the first and/or second retainer portion, via the respective inlet portion, and retained there. For example, since the first inlet portion is narrower than the first retainer portion, the first explosive element may be removable from the first retainer portion, via the first inlet portion, only by force—in other words, by deforming the foam material about the first inlet portion so that the first explosive element can pass through, or by forcing the first explosive element through the first inlet portion. This also applies to the second inlet and retainer portions, and the second explosive element, in the same way.

In some examples, the body 102 of the structure 100 comprises an opening 132 connected to the first cavity 118 and the second cavity 120, as shown in FIGS. 9 and 10. The opening 32 may, for example, allow a user to position the first explosive element in the first cavity 18, and position the second explosive element in the second cavity 20. In some examples, the opening 132 may allow the liner 108, or first liner and second liner, to be positioned in the body 102 by the user. In other examples, the liner 108, or first liner and second liner, may be manufactured integrally with the body 102, such that the user may position the first explosive element and the second explosive element in the first cavity 118 and the second cavity 120, respectively, to form a linear shaped charge which may then be primed for detonation.

Figure 11:
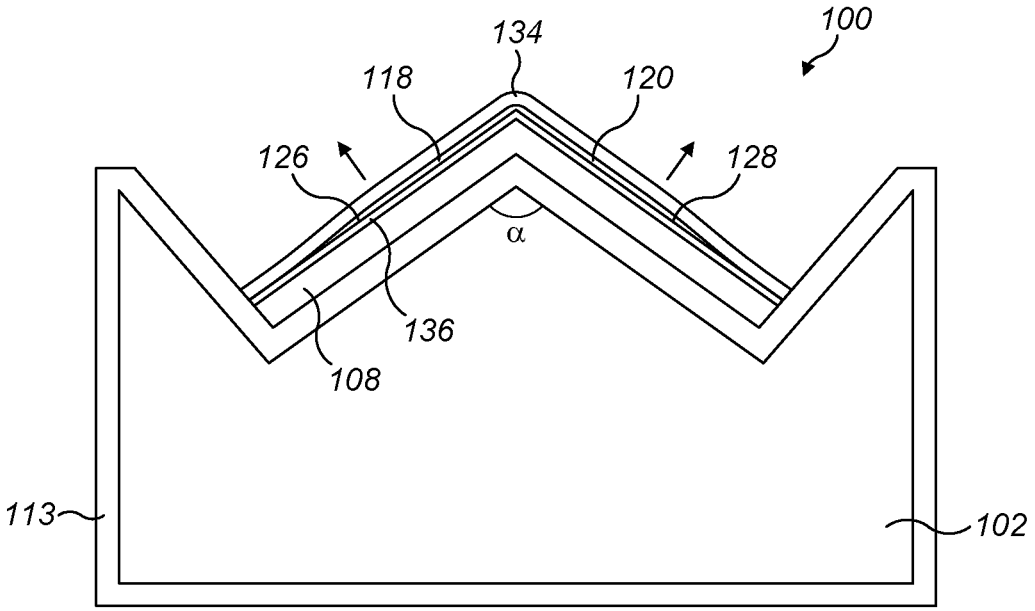

FIG. 11 shows an example structure 100 where the first cavity 118 and the second cavity 120 are each formed between an elastic layer 134 and an intermediate layer 136. The first flat surface 126 of the first cavity 118, and the second flat surface 128 of the second cavity 120 may each coincide with a surface of the intermediate layer 136. The elastic layer 134 may be deformable in a direction, indicated by arrows in FIG. 11, so that the first and second cavities 118, 120 may be enlarged to receive first and second explosive elements, respectively. In examples, the elastic layer 134 is attached to the intermediate layer 136 at particular locations, for example at the apex region of the intermediate layer, as shown in the figure. Therefore, the first and second cavities 118, 120 may be provided in regions between the elastic layer 134 and the intermediate layer 136, where those layers are not attached to each other. The first and second cavities may each receive detonation cord as the respective first and second explosive elements, to form the linear shaped charge example of FIG. 8.

In the example of FIG. 11, the body 102 is surrounded by a film 113, which is arranged between the liner 108 and the body 102. In certain cases, the film 113 may surround a part, and not the entirety, of the body 102. And in other examples the film may not be present.

A structure 100 for forming a linear shaped charge, as described in examples, allows for a lightweight, portable structure that is adaptable for various situations and/or target objects. For example, the user of the structure 100 may decide how much explosive material is required for a particular breach or other explosion, and load the required amount. This user-fillable nature of the structure 100 allows for a more resource efficient use of explosive material, and also allows for more adaptability in the field compared to pre-loaded charges with a predetermined mass of explosive material. Furthermore, in an unloaded state—for example a state without any explosive material present—the structure 100 for forming a linear shaped charge is more practical to transport, separate from the explosive material. As a foam body 102, possibly with an integrated liner 108 or liners 108, 109, the structure 100 is non-dangerous and may be transported and stored with ease.

The example structure 100 shown in FIG. 12 comprises a top, lid, or cover 140 which has an inset portion 142 that is insertable into the opening 132. The top 140 is hingeable about the hinge 144. For example, the top 140 may be bonded to the body 102 of the structure 100 such that it is hingeable in the direction of the arrow shown in FIG. 12. Therefore, when the top 140 is hinged in an open configuration, such that the inset portion 142 is not in the opening 132, the user has access to the first cavity 118 and the second cavity 120 to load the first and second explosive elements, respectively. The top 140 may then be hinged into a closed configuration, where the inset portion 142 is positioned in the opening 132, and in the channel between the first and second explosive elements. In this closed configuration, the inset portion 142 may allow the first and second explosive elements to be retained in their respective cavity, and may further allow for compression of the first and second explosive elements and of the linear shaped charge as a whole.

Figure 13:
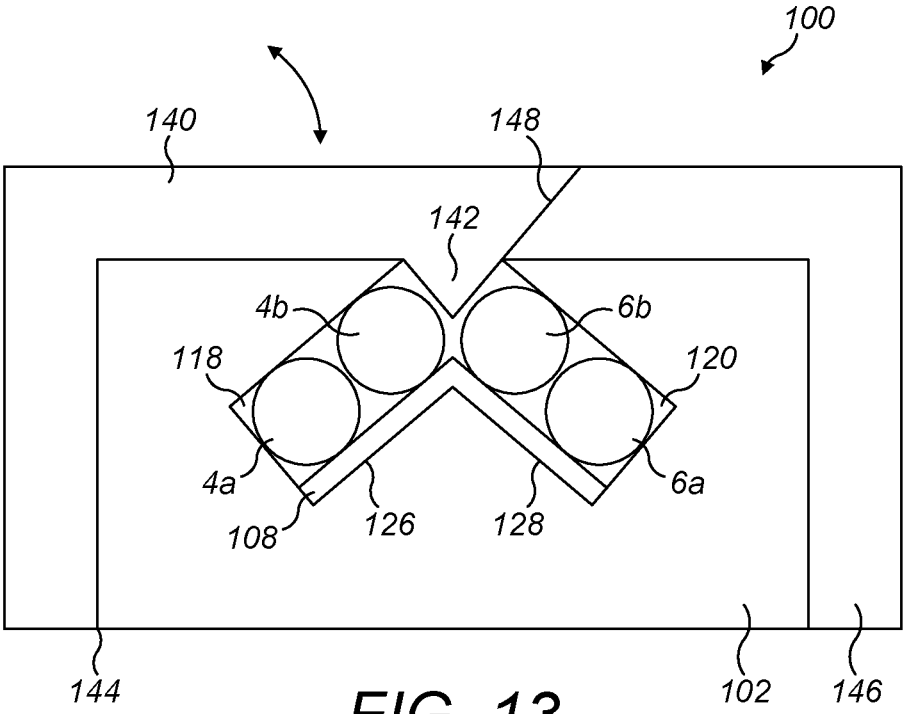

FIG. 13 shows an alternative example structure 100 having a top 140 hingeable about a hinge 144, as in the example of FIG. 12. However, the structure 100 in this example also has a fixed top portion 146 which is not hingeable relative to the body 102. Therefore, when the top 140 is hinged in an open configuration, such that the inset portion 142 is not in the opening 132, the fixed top portion 146 remains joined or bonded to the body 102. The top 140 may then be hinged into a closed configuration, where the inset portion 142 is positioned in the opening 132 and the channel between the first and second explosive elements, to meet the fixed top portion 146 at a join 148. The presence of the fixed top portion may provide stability and balance to the structure 100, for example for detonation, while also allowing the structure 100 to be flexible.

Figure 14:
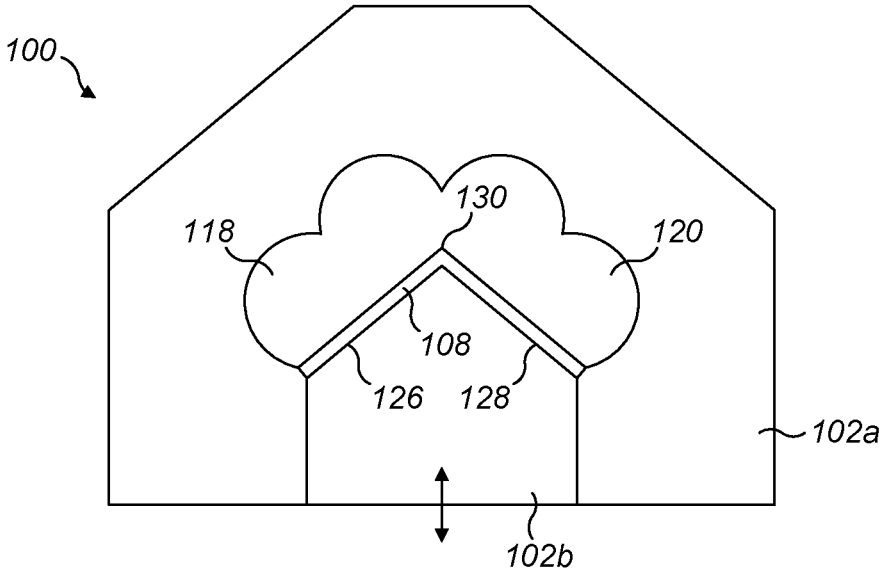

FIG. 14 shows a further example of a structure 100 for forming a linear shaped charge. The structure 100 has a first body portion 102*a* and a second body portion 102*b*, which may be assembled, as shown in the figure, to make the whole body 102 according to other examples described herein. The first body portion 102*a*, which may be considered a sheath or a cover, comprises the first cavity 18 and the second cavity 120, each of which may be shaped to correspond to a respective explosive element, for receiving the explosive element. For example, the first cavity 18 and the second cavity 120 may each contain grooves shaped to correspond to detonation cord, as shown in FIG. 14.

The second body portion 102*b*, which may be considered a plug or an insert, may contain the liner 108, as shown in FIG. 14. For example, the liner 108 may be joined to the second body portion 102*b* using an adhesive. In the example shown in FIG. 14, the second body portion 102*b* is removable from the first body portion 102*a*, as indicated by the double-headed arrow in the figure.

To form a linear shaped charge from the example structure 100 shown in FIG. 14, detonation cord may be inserted into the first and second cavities 118, 120 of the first body portion 102*a* when separated from the second body portion 102*b*. For example, the first body portion 102*a* may be inverted (with respect to the orientation shown in the figure) so that gravity would hold the inserted detonation cord in the respective first and second cavities 118, 120. The second body portion 102*b* may then be inserted into the first body portion 102*a* to form the linear shaped charge. For example, the second body portion 102*b* (plug) may be glued to the first body portion 102*a* (sheath) where their respective surfaces join or abut. The linear shaped charge formed would comprise a body, first and second explosive elements, a liner, and a channel between the first and second explosive elements.

As described with regards to the linear shaped charge 1 above, the foam material of the body 102 in any of the described examples may be formed of a polyethylene foam, for example low density polyethylene (LDPE) foam. The foam material may have a density of 15 to 60 kg $m^{-3}$, 25 to 60 kg $m^{-3}$, 35 to 60 kg $m^{-3}$, and more preferably 45 to 60 kg $m^{-3}$, 50 to 60 kg $m^{-3}$, or 55 to 60 kg $m^{-3}$. The previous description regarding the liner(s) and explosive elements in the context of linear shaped charges 1 also applies to the examples of structures 100 for forming a linear shaped charge.

Numerical ranges are given above. Although minimum and maximum values of such ranges are given, each numerical value between the minimum and maximum values, including rational numbers, should be understood to be explicitly disclosed herein. For example, a range of 101.5 to 106.5 degrees also discloses numerical values of for example 101.8, 103.57 and 104.636 degrees.

It is to be understood that any feature described in relation to any one example may be used alone, or in combination with other features described and may also be used in combination with one or more features of any other of the examples, or any combination of any other of the examples. Further examples are envisaged, for example, where the body 2, 102 may not be made of foam but instead may be formed of a non-foam material such as a plastic or a metal. For example, examples are envisaged where the body 2, 102 is a frame or other hollow structure made of a metal or other solid material. Furthermore, equivalents and modifications not described above may also be employed without departing from the scope of the accompanying claims.

What is claimed is:

1. A structure for forming a linear shaped charge, the structure comprising:

a body comprising a foam material;

an elastic layer;

a first cavity configured to receive a first explosive element;

a second cavity configured to receive a second explosive element;

i) a first liner, supported by the body, a first portion of the first liner corresponding to a first flat surface of the first cavity and a second portion of the first liner corresponding to a second flat surface of the second cavity, wherein the first flat surface and the second flat surface converge towards an apex and, with the first explosive element in the first cavity between the elastic layer and the first flat surface, and with the second explosive element in the second cavity between the elastic layer and the second flat surface, the elastic layer is configured for holding the first explosive element towards the first portion of the first liner, and for holding the second explosive element towards the second portion of the first liner, or ii) a first liner and a second liner, supported by the body, the first liner corresponding to a first flat surface of the first cavity and the second liner corresponding to a second flat surface of the second cavity, wherein the first flat surface and the second flat surface converge towards an apex and, with the first explosive element in the first cavity between the elastic layer and the first flat surface, and with the second explosive element in the second cavity between the elastic layer and the second flat surface, the elastic layer is configured for holding the first explosive element towards the first liner and for holding the second explosive element towards the second liner;

and an intermediate layer, the elastic layer attached to the intermediate layer, the first cavity and the second cavity between the elastic layer and the intermediate layer where the elastic layer is not attached to the intermediate layer.

2. The structure according to claim 1, wherein an apex angle between the first flat surface and the second flat surface is 101.5 to 106.5 degrees.

3. The structure according to claim 1, and in accordance with ii), the first cavity configured to receive the first explosive element, and the second cavity configured to receive the second explosive element, such that a side of the first explosive element adjacent to or in contact with the first liner extends no further than a plane of a side of the second liner nearest a face of the linear shaped charge.

4. The structure according to claim 1, and in accordance with ii), wherein the first liner and the second liner abut each other at an edge.

5. The structure according to claim 1, wherein the elastic layer is deformable to enlarge the first cavity to receive the first explosive element and the elastic layer is deformable to enlarge the second cavity to receive the second explosive element.

6. The structure according to claim 1, comprising:

a plurality of elastic layers with at least one cavity between two of the plurality of elastic layers, or a plurality of elastic layers with at least one cavity between two of the plurality of elastic layers, the plurality of elastic layers comprising the elastic layer.

7. The structure according to claim 1, comprising a plurality of cavities between a plurality of elastic layers, a respective cavity of the plurality of cavities, between two of the plurality of elastic layers, for receiving a respective explosive element, such that the respective explosive element in the respective cavity tessellates with an explosive element in an underlying cavity of the plurality of cavities, the plurality of cavities comprising at least one of the first cavity or the second cavity, and the plurality of elastic layers comprising the elastic layer.

8. The structure according to claim 1, the first cavity comprising the first explosive element and the second cavity comprising the second explosive element.

9. The structure according to claim 8, wherein at least one of the first explosive element or the second explosive element comprises detonation cord.

10. The structure according to claim 1, configured such that, with the first explosive element received by the first cavity, and the second explosive element received by the second cavity:

there is at least one of a recess or groove between the first explosive element in the first cavity and the second explosive element in the second cavity, or in accordance with i), there is at least one of a recess or groove between the first explosive element in the first cavity and the second explosive element in the second cavity, wherein a base of the at least one of the recess or groove comprises an edge of an apex of the first liner.

11. The structure according to claim 1, configured such that a stand-off distance SD between a point of the first liner or the second liner nearest a face of the linear shaped charge, the face being for application to a target object, and a plane of the face is at least 1.2 S, S being a distance, parallel to the stand-off distance SD, between the point of the first liner or the second liner nearest the face and the apex of the first liner and the second liner nearest the face.

12. The structure according claim 1, wherein, with the first explosive element received in the first cavity and the second explosive element received in the second cavity:

the first explosive element is connected to a first detonation system and the second explosive element is connected to a second detonation system, or the first explosive element is connected to a first detonation system and the second explosive element is connected to a second detonation system, the first detonation system and the second detonation system coupled to each other.

13. The structure according to claim 1, wherein at least one of:

the foam material comprises a polyethylene foam, or the foam material has a density of 15 to 60 kg $m^{-3}$, 25 to 60 kg $m^{-3}$, 35 to 60 kg $m^{-3}$, 45 to 60 kg $m^{-3}$, 50 to 60 kg $m^{-3}$, or 55 to 60 kg $m^{-3}$.

* * * * *